US007017242B2

(12) United States Patent
Bernasconi

(10) Patent No.: US 7,017,242 B2
(45) Date of Patent: Mar. 28, 2006

(54) SLIDER FOR ZIP FASTENER WITH TWO TABS AND A SINGLE FORK FOR RELEASING THE SLIDER

(75) Inventor: Sergio Bernasconi, Mendrisio (CH)

(73) Assignee: Riri S.A., Mendrisio (CH)

( * ) Notice: Subject to any disclaimer, the term of this patent is extended or adjusted under 35 U.S.C. 154(b) by 50 days.

(21) Appl. No.: 10/757,423

(22) Filed: Jan. 15, 2004

(65) Prior Publication Data

US 2005/0086775 A1 Apr. 28, 2005

(30) Foreign Application Priority Data

Oct. 28, 2003 (CH) ..... 1839/03

(51) Int. Cl.
*A44B 19/30* (2006.01)

(52) U.S. Cl. ..... 24/422

(58) Field of Classification Search ..... 24/415, 24/424, 418–422
See application file for complete search history.

(56) References Cited

U.S. PATENT DOCUMENTS 2,423,210 A * 7/1947 Ulridh et al. ..... 24/422
2,657,444 A * 11/1953 Bashover ..... 24/422
2,953,831 A * 9/1960 Morin ..... 24/422
3,006,050 A * 10/1961 Brown ..... 24/422
3,129,480 A * 4/1964 Carlile ..... 24/422

* cited by examiner

*Primary Examiner*—William L. Miller
*Assistant Examiner*—Ruth C. Rodriguez
(74) *Attorney, Agent, or Firm*—Young & Thompson

(57) ABSTRACT

A slider (1) for zip fasteners with two tabs (2, 3), comprising a hollow body (4) in which are positioned structure (10, 5, 6) designed in such a way that, when either one of the two tabs (2, 3) is pulled, this causes the disengagement of a pawl (7) from the teeth (Zi) of a fastener, overcoming the resistance of elastic structure (8, 9) which keep the pawl inserted between the teeth (Zi). In the slider (1) a fork (10) is provided with two prongs (5, 6) positioned on opposite sides of the plane (β) of the teeth (Zi) and pivoted at a point (P, Q) of the slider (1) in such a way that it can rotate in a plane (α) perpendicular to the plane (β) of the teeth (Zi) when a force is exerted on at least one (6) of its prongs (5, 6) by the tab (3) connected to it by its ring (3*a*).

1 Claim, 6 Drawing Sheets

SLIDER FOR ZIP FASTENER WITH TWO TABS AND A SINGLE FORK FOR RELEASING THE SLIDER

An example of such a slider is described in the patent EP 204 186 B1 held by YKK, and another example is illustrated in Swiss patent application 01697/03 filed by the present applicant.

The present invention relates to the field of what are called "zip fasteners", in other words fasteners which can be opened and closed by pulling on either one of two tabs connected on opposite sides, by means of their rings, to a slider, in other words to the member which joins and disengages the teeth of the fastener.

In both of the said examples, the slider is locked in its position by means of a pointed member which penetrates between the teeth of the fastener, and in order to move the slider it is first necessary to disengage this member, which can also be called a "pawl", from the teeth.

To ensure that this locking operation can be performed by pulling as stated on either one of the two tabs connected to the slider, the terminal rings of the tabs are connected to two levers, located inside the hollow body of the slider on opposite sides of the plane of the fastener, and interconnected by contact or by means of suitable return members. One of these levers is connected integrally to the aforesaid pawl, and the levers are designed and positioned in such a way that a pull on either one of the two tabs will directly or indirectly cause the movement of the pawl in such a way as to disengage it from the teeth of the fastener.

The manufacture of the levers described above and of the corresponding actuating systems entails production and assembly costs which, given the intrinsically relatively low value of a slider with two tabs, have a significant effect on the final cost.

Moreover, since an increase in the number of parts of an assembly also increases the potential causes of malfunction, the reliability of sliders made as described above can sometimes be inadequate, and in order to achieve correct operation it is necessary to use more costly methods and materials, which in turn have an additional effect on the price.

The inventor of the slider with two tabs according to the present invention has devised a solution in which the aforementioned two levers form a single piece, and more specifically a single fork whose two prongs perform the function of the two levers. This fork, connected by means of the aforesaid prongs to one of the sliders and to the pawl described previously, is pivoted within the hollow body of the slider, and is shaped and positioned in such a way that, by pulling as stated on either one of the two tabs, the user can act on the pawl in such a way that it is disengaged from the teeth of the fastener so that the slider can be moved.

Like all sliders with two tabs, the slider according to the invention, as described below, comprises elastic means for keeping the pawl inserted between the teeth of a fastener until, when the prongs are acted on, these means are deformed elastically to a sufficient degree to disengage the pawl.

The object of the present invention is therefore a slider for fasteners with two tabs as described in the attached claim 1.

Two examples of embodiment of the slider according to the invention will now be described, with additional reference to the attached drawings, in which.

Figure 1:
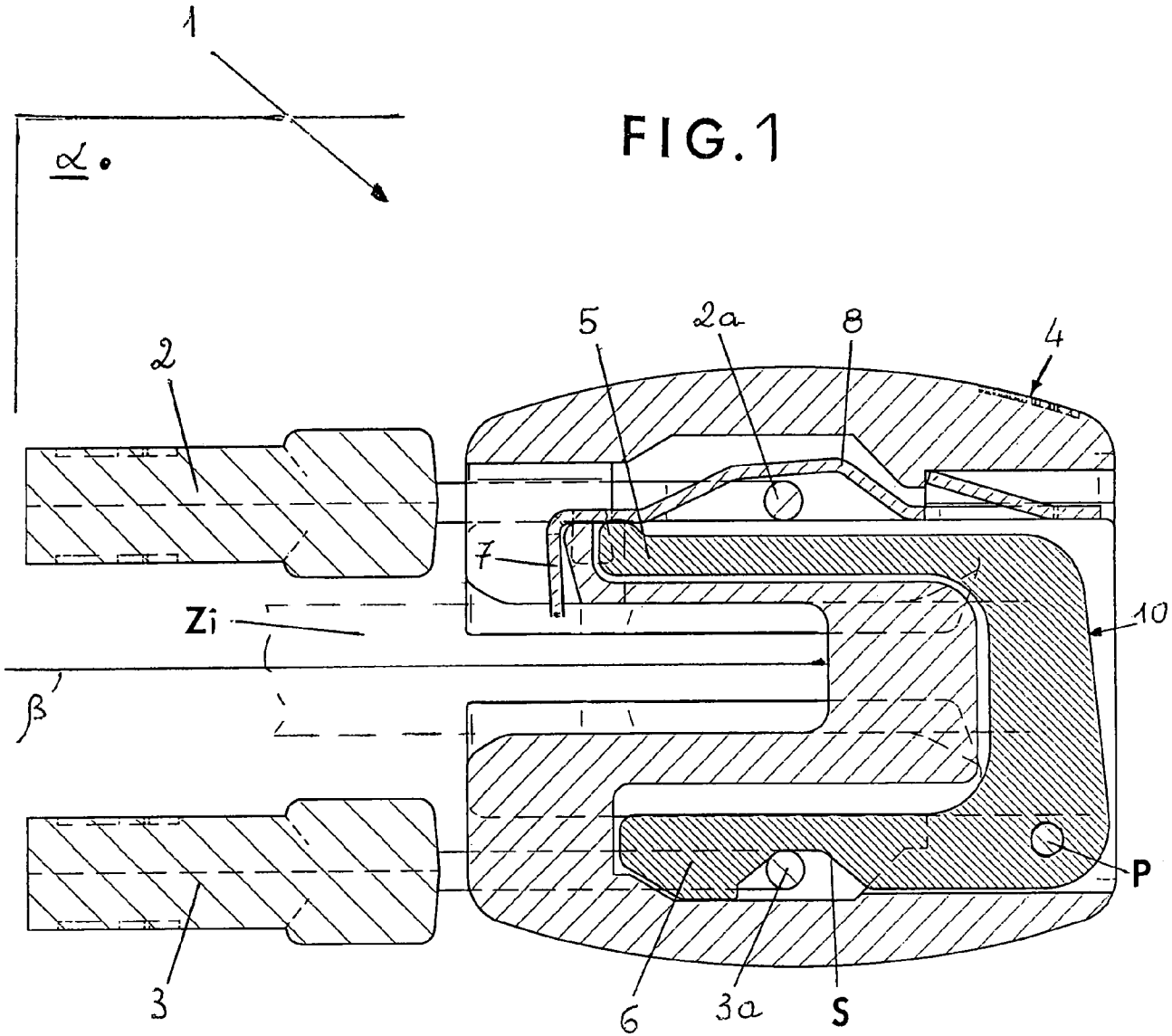
FIG. 1 is an enlarged longitudinal section through a first example of embodiment of the slider according to the invention, in which the pawl does not form part of the fork, and is provided with an elastically flexible portion which keeps it inserted between the teeth of a fastener.
Figure 2:
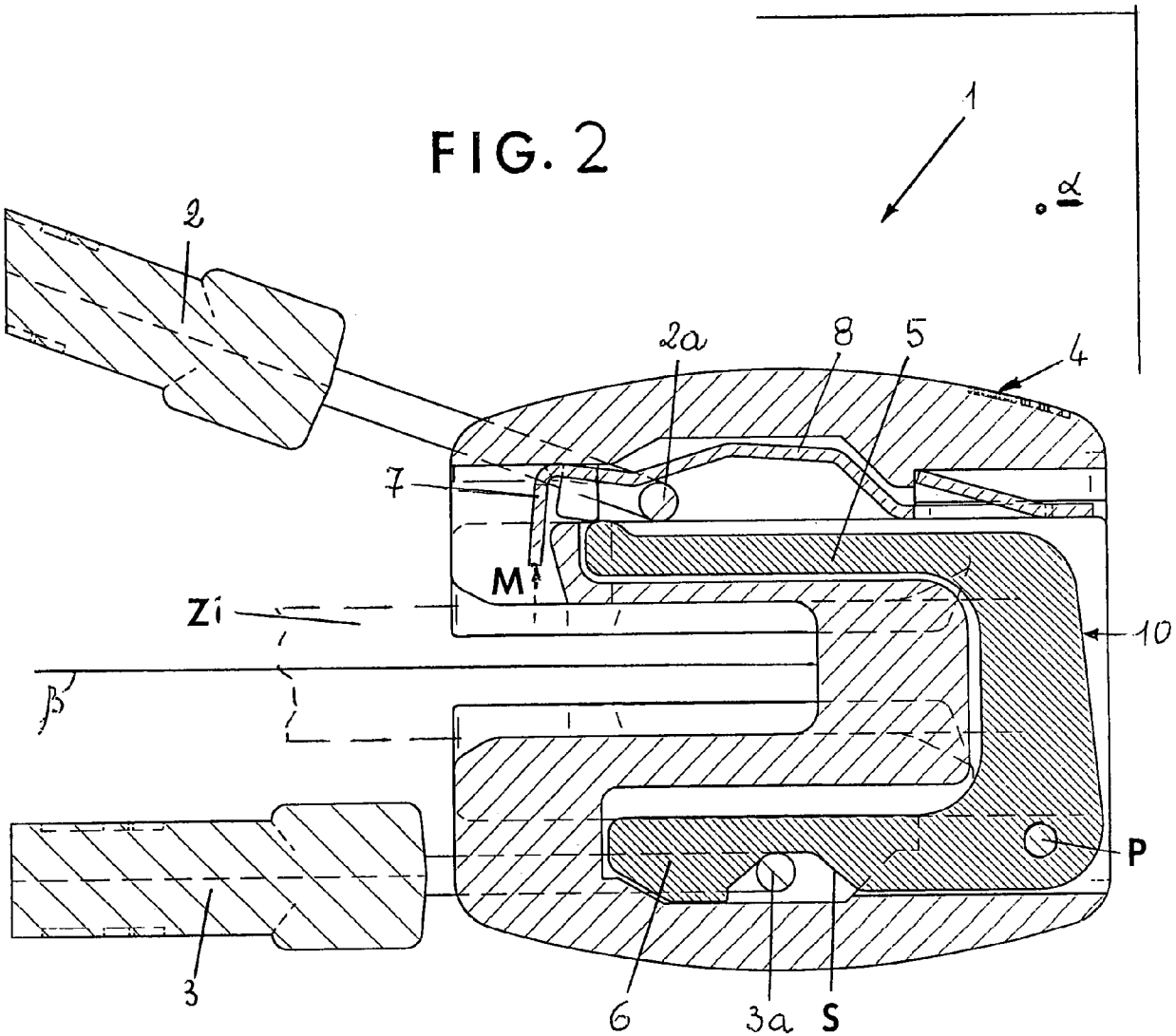
FIG. 2 is the same longitudinal section as that shown in FIG. 1, in which the fork has been made to rotate by a pull on the tab in the upper part of the drawing, in such a way that the aforesaid pawl is disengaged from the teeth of the fastener.
Figure 3:
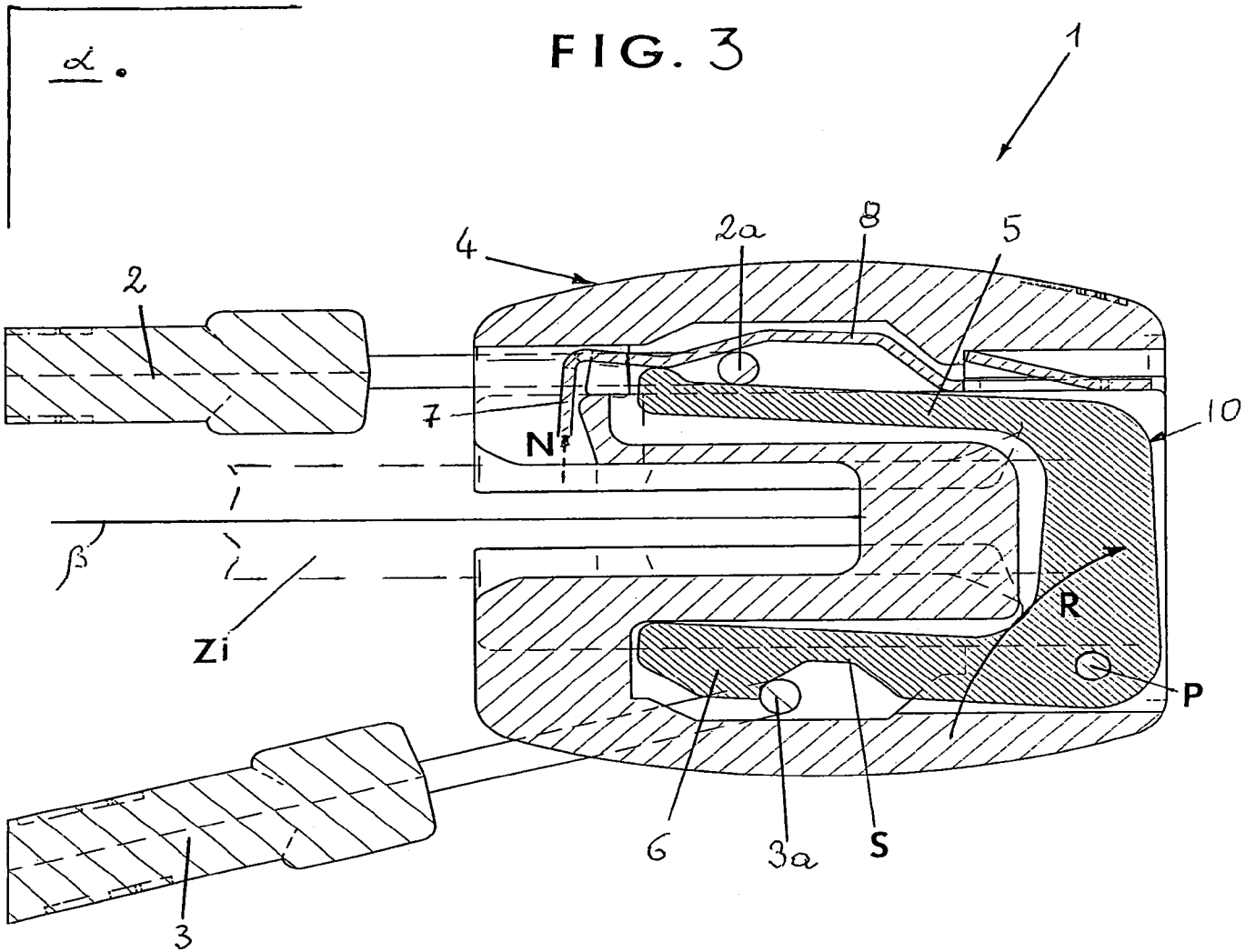
FIG. 3 is the same section as that shown in the preceding figures, in which the pawl is disengaged from the teeth of the fastener by a pull on the tab in the lower part of the drawing.

With reference initially to FIGS. 1, 2, 3, these show how, in a slider 1 with two tabs 2 and 3 according to the invention, its hollow body 4 houses within it a fork 10, pivoted at a point P of the slider and consisting of two prongs 5 and 6 positioned on opposite sides of the plane β occupied by the teeth Zi of a fastener (not all of which is shown). A flexibly elastic strip 8 terminates in a pawl 7, and the strip 8 is shaped in such a way that, when no force is applied to it, its pawl 7 is kept inserted between the teeth Zi to keep the slider 1 locked. The strip 8 is positioned so that it faces and is parallel to one prong 5 of the fork 10.

The tab 2 in the upper part of the drawing is connected by its ring 2*a* to the strip 8 in such a way that pulling the tab (see FIG. 2) causes the pawl 7 to be disengaged from the teeth Zi (arrow M).

The tab 3 in the lower part of the drawing is connected by its ring 3*a* to the prong 6 in the lower part of the drawing, and pulling this tab causes a rotation (arrow R in FIG. 3) of the fork 10 about the point P, in a plane α perpendicular to the plane β of the teeth Zi, which makes the prong 5 in the upper part of the drawing, which is in contact with the strip 8, cause an elastic deformation of the strip in this case also, thus disengaging the pawl 7 from the teeth Zi (arrow N).

It should be noted that, whereas the tab 2 in the upper part of the drawing acts directly by traction on the strip 8, the tab 3 in the lower part of the drawing acts on the prong 6 by pressing with its ring 3*a* on a surface with inclined planes S in such a way as to cause the rotation R of the fork 10.

This system of connection by means of inclined planes is known to those skilled in the art.

Figure 4:
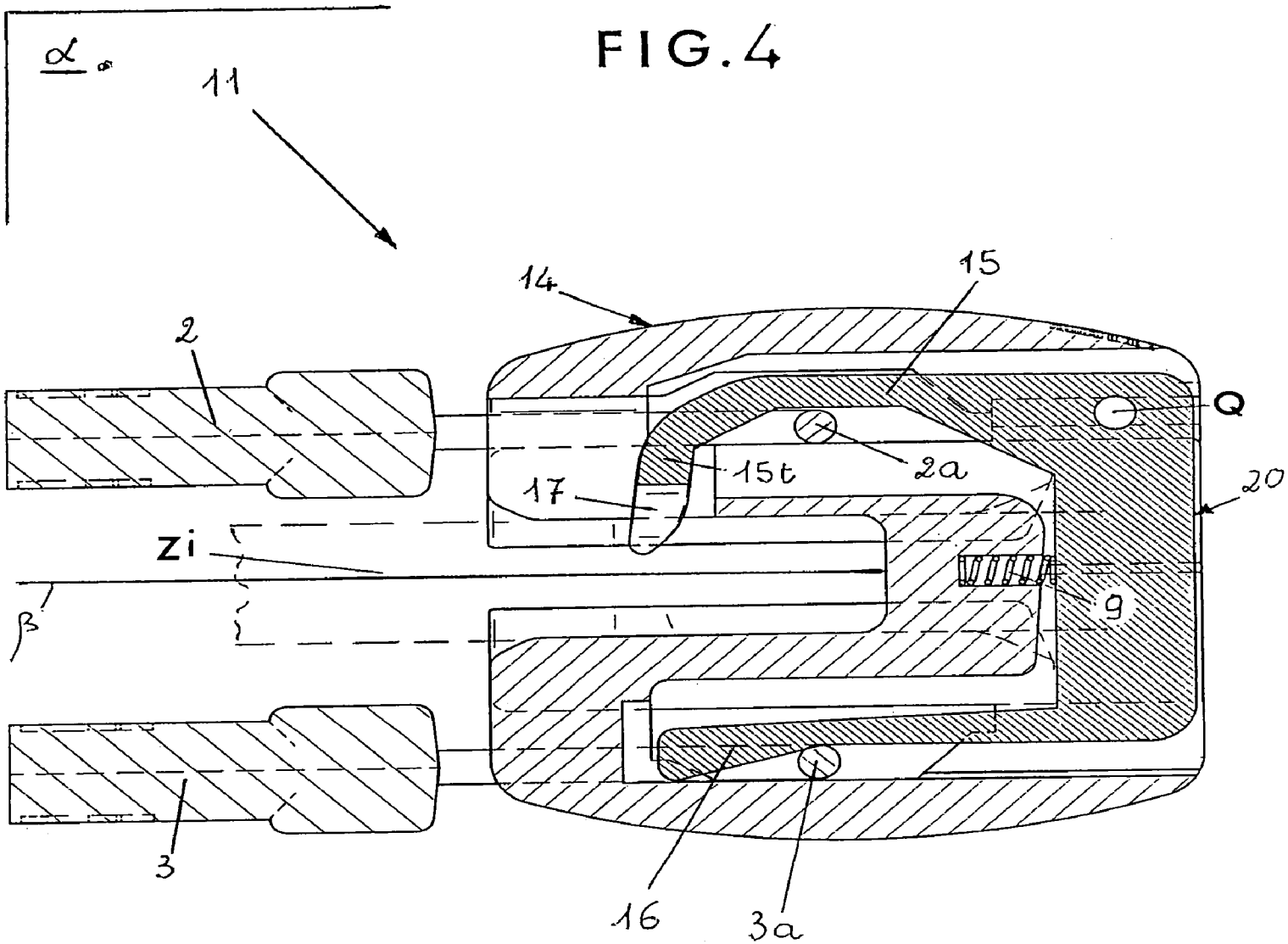
FIG. 4 is the enlarged longitudinal section through a second example of embodiment, in which the pawl is formed integrally on the terminal part of one of the prongs of the fork, and the elastic means for returning the pawl to the position in which it locks the slider consist of a spring interposed between the fork and the hollow body of the slider.

FIG. 4 shows another example of embodiment 11 of the slider according to the invention. In this case also, the slider 11 has a hollow body 14 in which is housed a fork 20 with two prongs 15 and 16, pivoted at a point Q in such a way that it can rotate (arrow O, FIGS. 5 and 6) in a plane α perpendicular to the plane β of the teeth Zi of the fastener (again not all of which is shown).

In this case, however, the pawl 7 does not form part of a separate member, but is formed integrally on the free end 15*t* of a prong 15, which is drawn in the upper part of the figure.

Figure 5:
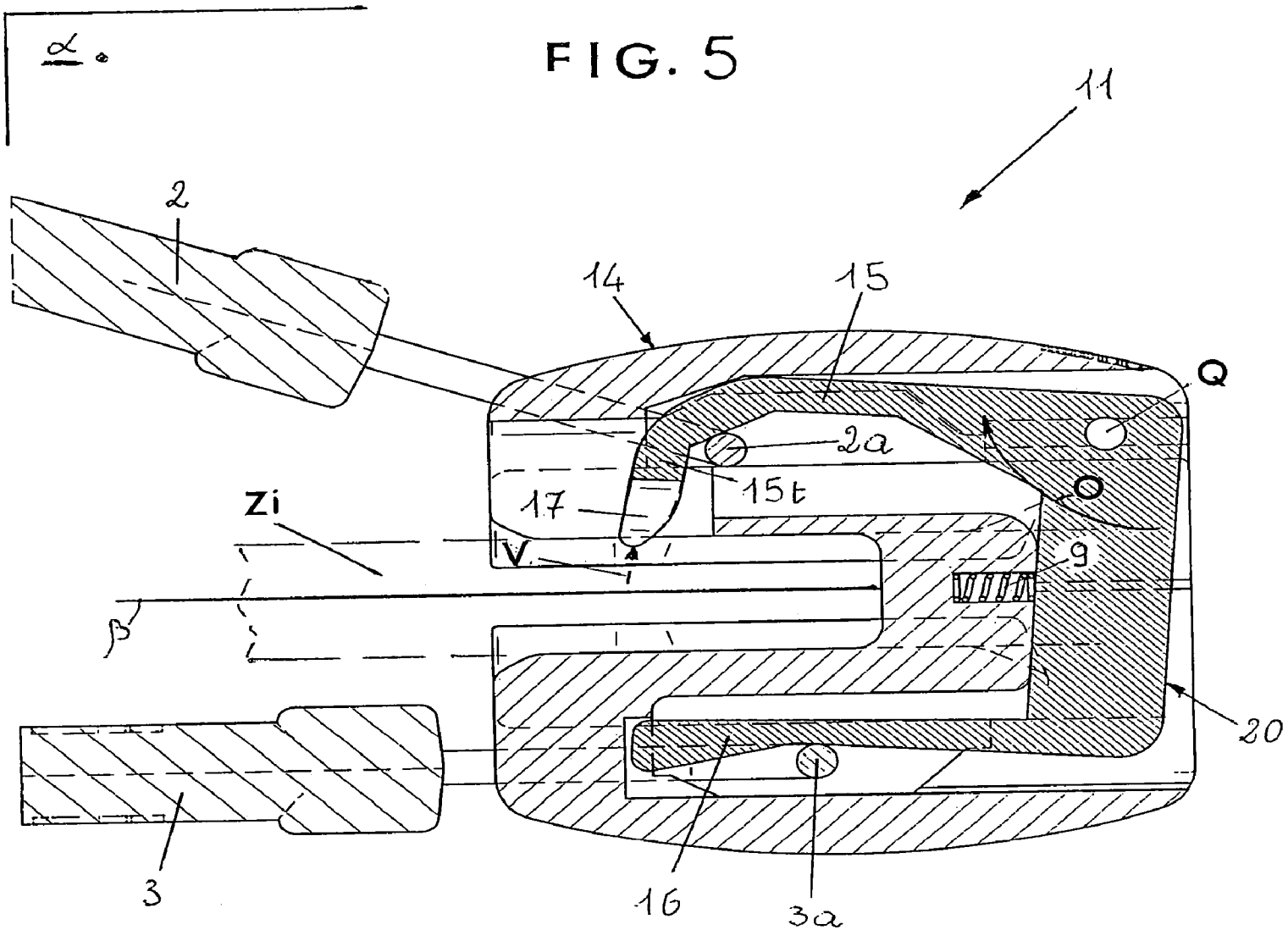
FIG. 5 is the same longitudinal section as that shown in FIG. 4, in which the prong bearing the pawl has been made to rotate, thus disengaging the pawl, by means of the tab in the upper part of the drawing.
Figure 6:
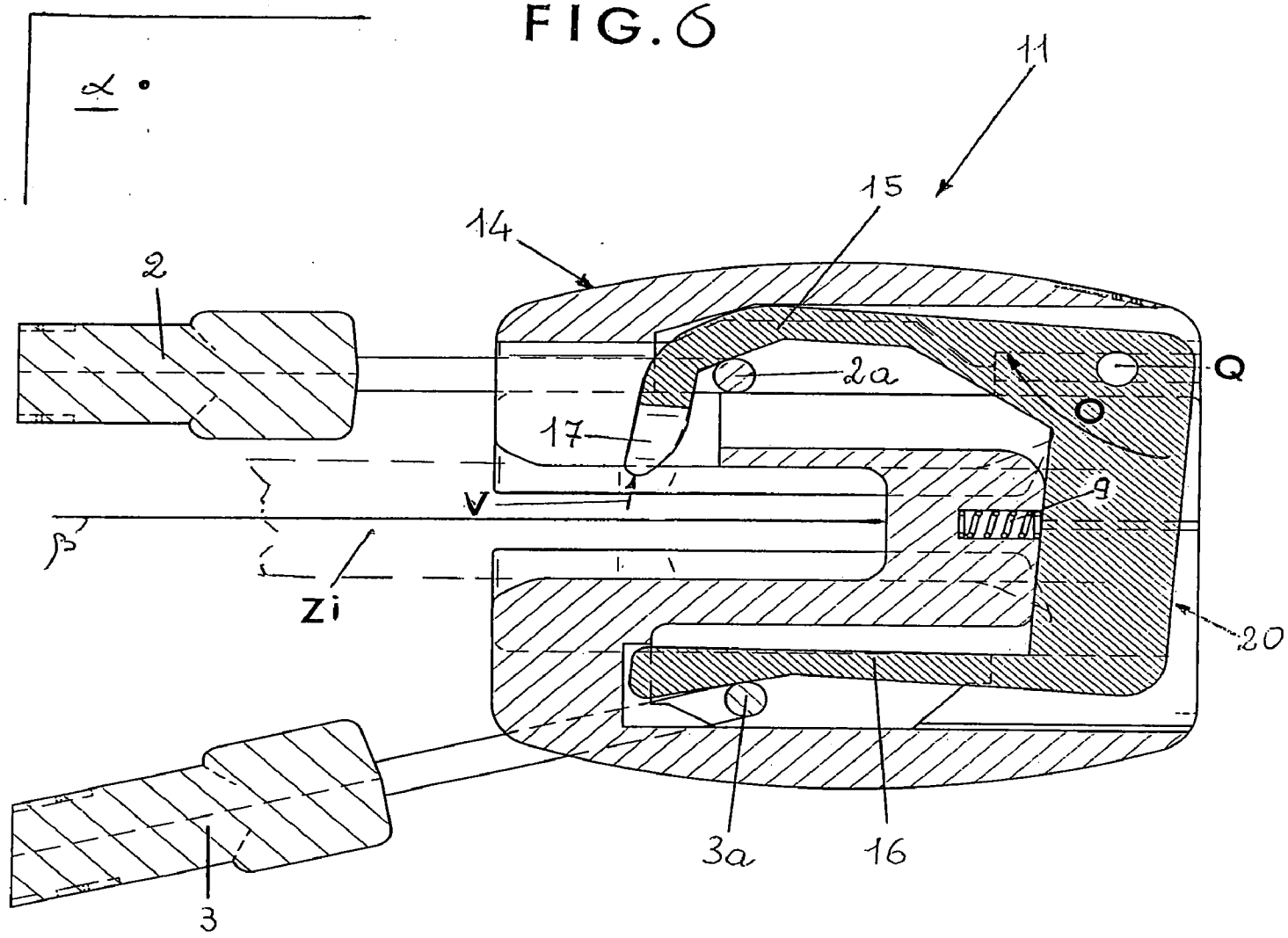
FIG. 6 is the section shown in FIG. 5, in which the prong bearing the pawl has been made to rotate by a pull on the other prong of the fork by means of the tab in the lower part of the drawing.

As shown in FIGS. 5 and 6, pulling on either one of the two tabs 2 and 3 connected by their rings 2*a* and 3*a* to the two prongs 15 and 16 makes the fork 20 rotate in the direction of the arrow O, thus extracting (arrow V) the aforesaid pawl 17 from the teeth Zi of the fastener.

In this case, the elastic force which keeps the pawl 17 inserted between the teeth Zi is provided by a spring 9 interposed between the fork 20 and the hollow body 4 of the slider 11, the spring being positioned and designed in such a way as to oppose the rotation O of the fork 20.

In both embodiments described above, a slider 1, 11 according to the invention is provided, this slider consisting of a smaller number of components and being consequently more reliable and less expensive to produce.

What is claimed is:

1. Slider (1, 11) for zip fasteners with two tabs (2, 3), comprising a hollow body (4) in which hollow body are positioned means (10, 20, 5, 6, 15, 16) designed in such a way that, when either one of said two tabs (2, 3) is pulled, this causes the disengagement of a pawl (7, 17) from the teeth (Zi) of a fastener, overcoming the resistance of elastic means (8, 9) which keep the pawl inserted between said teeth (Zi), characterized in that said means consist of a fork (10, 20) provided with two prongs (5, 6, 15, 16) positioned on opposite sides of the plane (β) of the aforesaid teeth (Zi) and pivoted at a point (P, Q) of the slider (1, 11) in such a way that it can rotate in a plane (α) perpendicular to said plane (β) of the teeth (Zi) when a force is exerted on at least one (6, 16) of its prongs (5, 15, 6, 16) by means of the tab (3) connected to it by its ring (3*a*), and wherein one (2) of the two tabs (2, 3) is connected to an elastic strip (8) terminating in said pawl (7) in such a way that it can disengage the pawl from the teeth (Zi), and the other tab (3) is connected to a prong (6) of the fork (10), the other prong (5) facing said elastic strip (8) in such a way that a rotation (R) of the fork (10) caused by the aforesaid other tab (3) also causes the said disengagement from the teeth (Zi) as a result of the movement of said other prong (5).

* * * * *